United States Patent [19]

Finlay

[11] Patent Number: 4,605,251

[45] Date of Patent: Aug. 12, 1986

[54] DOOR LOCK

[76] Inventor: John R. Finlay, 900 Garrison Ave., Kettering, Ohio 45429

[21] Appl. No.: 633,341

[22] Filed: Jul. 23, 1984

[51] Int. Cl.[4] ..... E05C 1/04

[52] U.S. Cl. ..... 292/288; 292/156; 292/147; 292/DIG. 38

[58] Field of Search ..... 292/1, 288, 292, 336.3, 292/147, 156, 162, 347

[56] References Cited

U.S. PATENT DOCUMENTS

| | | | |
|---|---|---|---|
| 720,496 | 2/1903 | Simpson | 292/156 |
| 1,571,024 | 1/1926 | Scheid | 292/156 |
| 3,208,029 | 9/1965 | Leslie | 339/252 P |
| 4,004,833 | 1/1977 | Hull | 292/288 |

*Primary Examiner*—Richard E. Moore

*Attorney, Agent, or Firm*—G. J. Muckenthaler

[57] ABSTRACT

A U-shaped lock fits around the shank of the door knob assembly and the two legs of the lock are received by an extended strike plate in a locked condition. The door lock is retained around the shank by keeper means on at least one of the legs of the lock.

18 Claims, 8 Drawing Figures

FIG-4
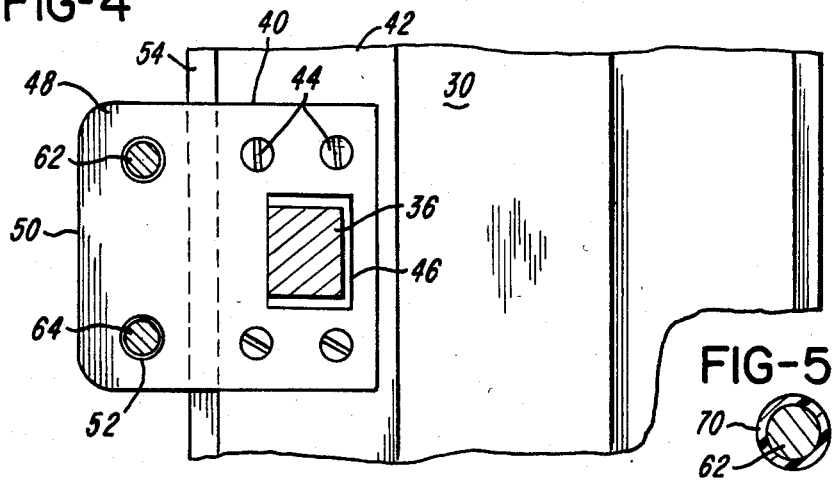
FIG-5
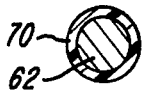
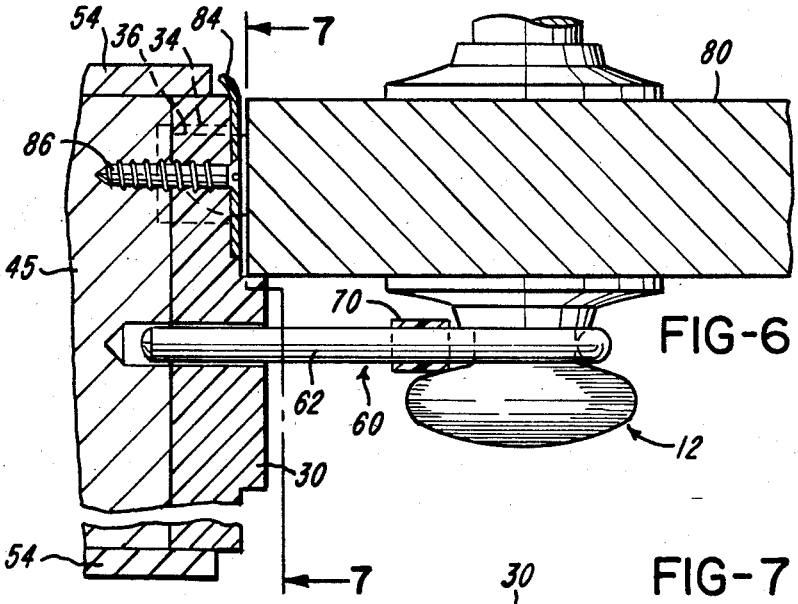
FIG-6
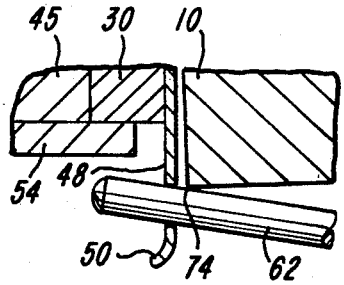
FIG-3A
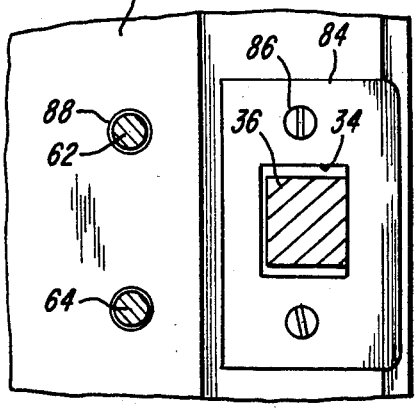
FIG-7

DOOR LOCK

BACKGROUND OF THE INVENTION

In the field of door locks or locking devices for doors, it is deemed necessary to provide such locks or devices that prevent unauthorized entry. The ordinary lock set generally includes a knob on either side of the door along with a tumbler and bolt mechanism associated with a latch plate and means for locking the tumbler from the inside of the door.

Additionally, secondary means in the form of night locks or latches are used as a deterrant to illegal entry, however the typical chain-connected device is only as strong as the screws that hold the chain support or anchor to the door trim. Another form of night latch includes a bolt carried in a retainer and slidable in a channel or slot therein and engageable with a catch or aperture in a member attached to the door jamb, or more commonly, to the door frame trim board.

Further, in view of the increased number of burglaries, the use of dead bolts has become quite common to provide extra protection. A typical dead bolt may include a tumbler operated by a key on the outside of the door and a turn knob on the inside to cause the bolt to move into and out of an opening in the door jamb.

Representative documentation in the field of door locks and like securing devices includes U.S. Pat. No. 827,624, issued to G. H. Foster on July 31, 1906, which discloses a door securer of generally flat sheet steel wherein one member is anchored in the door frame and includes a rivet or bolt slidable in a slot of an arm member clamped or snapped around the shank of the door knob.

U.S. Pat. No. 1,239,802, issued to R. A. Macbeth on Sept. 11, 1917, discloses a metal plate with lugs or ears at its opposite ends, one end having a lug with an aperture to accommodate a coupling rod hooked at one end thereof around the shank of the door knob and the other end providing a fork to accommodate a wing nut threaded on the coupling rod.

U.S. Pat. No. 1,894,913, issued to L. M. Sadler on Jan. 17, 1933, discloses a sliding doorlatch having a U-shaped housing and a latch extending through the housing along with a square shaft slidably engaging the latch and rotatable in the housing.

U.S. Pat. No. 2,536,352, issued to N. W. Butcher on Jan. 2, 1951, discloses a staple extension for padlocks having a metal rod for extending through a pair of securing loops and including a loop at one end of the rod for accommodating the padlock.

U.S. Pat. No. 3,633,955, issued to G. D. Read on Jan. 11, 1972, discloses a swinging door lock construction having a single L-shaped lock frame with an edge part forming a strike plate and extending along and secured to the door jamb. A bolt opening is formed through the juncture between the edge and side parts and slidably receives a sheet-like bolt.

U.S. Pat. No. Re 28,893, reissued to A. D. Adkison on July 6, 1976 (Reissue of U.S. Pat. No. 3,731,965, issued May 8, 1973), discloses a planar member between the door frame and the door with a tab disposed at a right angle to the member and adapted to be received in a notch. A pair of slots in the member present seats for receiving a keeper pin adjacent the door to present a dead bolt lock.

And, U.S. Pat. No. 4,004,833, issued to H. L. Hull on Jan. 25, 1977, discloses a door lock device comprising a lock bolt received upon the shaft of the door knob and extending into an aperture in a retaining plate attached to the door jamb.

SUMMARY OF THE INVENTION

The present invention relates to locking or holding devices for doors and, more particularly, to a door lock that includes an extended strike plate as a substitute or replacement for the commonly used strike plate and which defines a generally rectangular aperture therein for receiving the bolt and also a pair of round apertures for receiving the ends of a U-shaped rod member.

The U-shaped rod member is positioned around and placed on the shank of the door knob with the extending portions of the U-shape directed in a horizontal direction to be received by the pair of round apertures in the striker plate. The U-shaped rod member also includes keeper means in the form of plastic, rubber or like composition sleeves on the extending portions and positioned thereon beyond the diameter of the door knob shank to retain the rod member thereon.

The rod member, when in a locking position, extends in the horizontal direction, whereas in the unlocked position, the rod member is placed in the vertical direction and hangs from the shank of the door knob. When the door is attempted to be opened with the rod member in the locked position, the leading edge of the door is jammed against the legs or extending portions of the member thereby prohibiting opening the door.

In accordance with the above discussion, the principal object of the present invention is to provide a door lock that is simple in design and construction of the parts.

Another object of the present invention is to provide a door lock that is easily installed and operated and which requires no particular expertise in the art of lock installation.

An additional object of the present invention is to provide means for securing a door of the flush type or one of the recessed type regardless of which side of the leading edge of the door on which the knob is mounted.

A further object of the present invention is to provide a door lock that fits the shank of the door knob and engages the strike plate in a locked condition and is supported from the door knob shank in an unlocked condition.

Still another object of the present invention is to provide a door lock of portable nature wherein removal and replacement of the original strike plate is easily accomplished upon change of occupancy of the building.

Additional features and advantages of the present invention will become apparent and fully understood from a reading of the following specification taken together with the annexed drawing.

BRIEF DESCRIPTION OF THE DRAWING

FIG. 3A is a partial view of FIG. 3 and showing the door in the binding position;

FIG. 4 is a view taken along the line 4—4 of FIG. 1;

FIG. 5 is a sectional view taken on the line 5—5 of FIG. 2;

FIG. 6 is a view, partially in section, of the door lock for use on a recessed type door; and FIG. 7 is a view taken on the line 7—7 of the modification of FIG. 6.

DESCRIPTION OF THE PREFERRED EMBODIMENT

Figure 1:
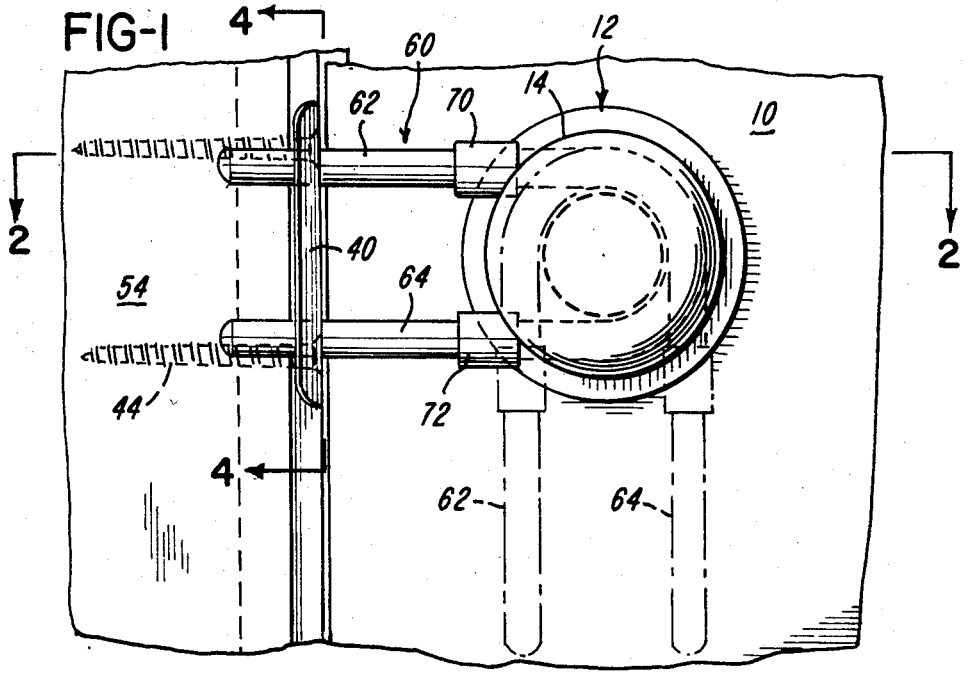
FIG. 1 is a front view of a preferred embodiment of the subject matter of the present invention.

Referring now to the drawing, FIG. 1 illustrates a front view looking from the inside of a door 10 in and at the area wherein a door knob assembly 12 is positioned and installed in the door in appropriate and well-known manner. The door knob assembly or lock set 12 includes an inner knob 14 and an outer knob 16 (FIG. 2), there being a shank portion 18 and a shank portion 20 connected in known manner with a tumbler or like mechanism (not shown), and the knob assembly includes a flange 22 for the inner shank portion and a flange 24 for the outer shank portion.

The door 10 is operably associated with a door jamb 30 wherein, in the normally closed position, the edge of the door seats against a ledge or cutout portion 32 of the jamb in tightly engaging manner. The door jamb 30 includes a cutout 34 therein, horizontally disposed from the door knob assembly 12, for receiving a bolt 36 of the knob assembly which is connected with the tumbler mechanism in known manner.

Figure 2:
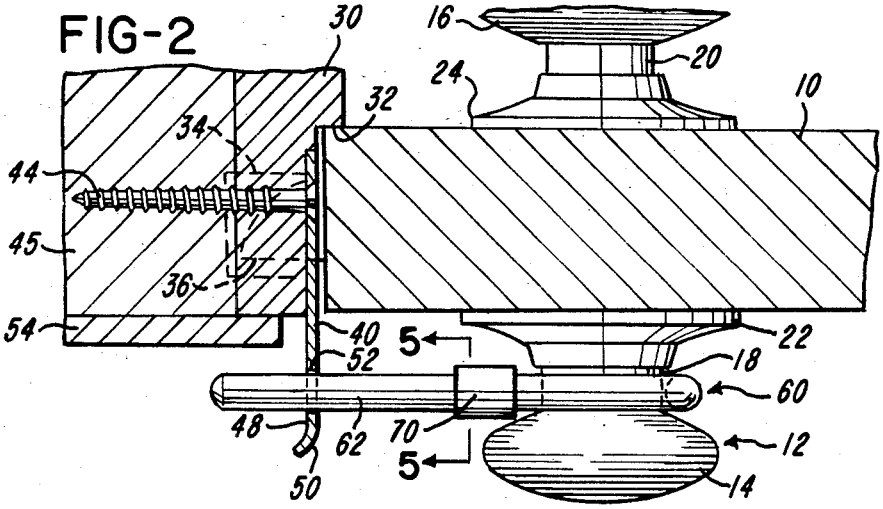
FIG. 2 is a view, partially in section, taken on the line 2—2 of FIG. 1.

A strike plate 40 (see also FIG. 4) is secured to the face 42 of the jamb 30 by means of four screws 44 inserted through appropriate apertures in the strike plate and extending into a structural member 45 (FIG. 2). The strike plate 40 includes a rectangular opening 46 for receiving and accommodating the bolt 36 of the door knob assembly 12. The strike plate 40 also includes an extended portion 48 having a curved edge 50 (FIGS. 2 and 3) for slidably accommodating the curved portion of the bolt 36 when the door 10 is operated in closing manner. The extended portion 48 includes a pair of apertures 52 therein (FIG. 4) for receiving components of the door locking structure of the present invention. A trim member 54 is suitably attached to the surfaces of the structural member 45 and the door jamb 30.

A U-shaped member, generally designated as 60, is formed to fit around the shank 18 of the door knob assembly 12 (FIGS. 1 and 2) and is made of round rod stock and having the two legs 62 and 64 of a length sufficient to be received by the apertures 52 in the extended portion 48 of the strike plate 40.

A pair of keepers 70 and 72, each preferably in the form of a short piece of pliant plastic tubing, are placed on the legs 62 and 64 (FIG. 1) adjacent the shank portion 18 of the door knob assembly 12. The keepers 70 and 72 are sized relative to the diameter of the legs 62 and 64 and also sized relative to the diameter of the shank 18 so as to maintain the door lock 60 in place when in the horizontal position, as illustrated in FIG. 1, and also to prevent inadvertent or extremely easy removal of the legs 62 and 64 from the apertures 52 of the strike plate 48, by providing a somewhat frictional contact between the surface of the shank 18 and the outside diameter surface of the keepers 70 and 72 when the door lock 60 is urged toward the right in FIGS. 1 and 2.

FIG. 5 illustrates a sectional view of leg 62 of the door lock 60 with the keeper 70 in place therearound. It is preferred that the keepers 70 and 72 be sized and made of a plastic or like material to provide a frictional fit over the legs 62 and 64 so as to substantially retain the keepers in position when the door lock 60 is unlocked from the strike plate 48. Of course, it is entirely feasible that only one keeper, as 70, may be required to provide the function of keeping the door lock 60 from inadvertently being removed from the strike plate 48, dependent upon the diameter of the door shank 18. An alternative element to the short tubing 70 may be an O-ring of appropriate size to perform the keeping function.

Figure 3:
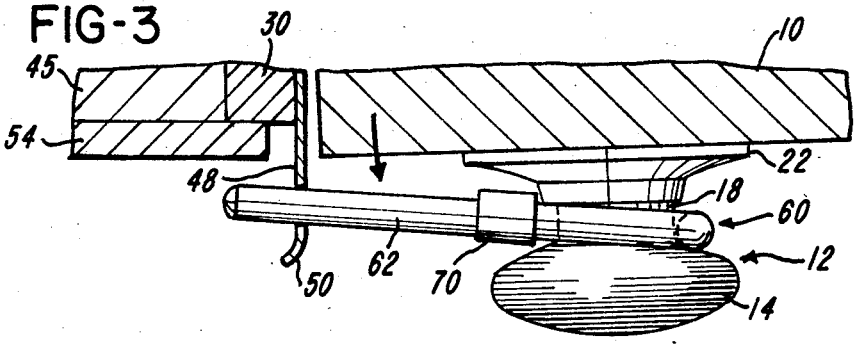
FIG. 3 is a view of a portion of the door and the door lock when the door is attempted to be opened.

FIG. 3 readily illustrates the operation of the door lock 60 when the door 10 is caused to be opened a slight amount. The door 10 is moved in a substantially straight direction (downwardly in FIG. 3) and the door lock 60 is caused to be moved to a slightly slanted position with the corner or leading edge 74 of the door against the legs 62 and 64 in a jammed or binding condition, as better shown in FIG. 3A. In this manner the door 10 is prevented from being opened and the door lock 60 cannot be eased out of this position by reason of the binding effect of the door lock against the back or inside of the knob 14. The binding condition is effective with the door leading edge 74 engaging the legs 62 and 64 and the jamming of the curved portion of the door lock 60 against the door knob 14, i.e. the simultaneous binding of the leading edge of the door 10 in conjunction with the door lock against the knob.

FIGS. 6 and 7 illustrate a variation of the locking arrangement of the present invention wherein a recessed door 80 is provided with the door knob assembly 12 and is operably associated with the door jamb 30 that defines the cutout 34 for the bolt 36. In this case the original standard strike plate 84 is retained and secured by appropriate screws, as at 86, and of course it is readily seen that the bolt 36 is reversed in orientation from the FIG. 2 illustration. The door jamb 30 is drilled to provide a pair of openings, as at 88, (FIG. 7) to receive the legs 62 and 64 of the door lock 60.

As seen in FIGS. 1 and 2, the screws 44 are sufficiently long to extend through the door jamb 30 of nominal thickness and preferably extend into the door framing stud 45 for added strength and security. Likewise, the legs 62 and 64 of the door lock 60 (FIG. 6) preferably extend through the door jamb 30 and into the framing structure 45 for additional strength.

The preferred representations of the several parts for use in practicing the present invention include 13 gauge steel plate for the strike plate 40 and 5/16 inch rod for the U-shaped member 60 along with appropriately sized clear plastic sleeves 70 and 72.

It is thus seen that herein shown and described is a door lock that provides security and protection from unauthorized entry, that is easily placed in the locked position, and that remains with the door knob in a convenient location when the lock is not being used for securing the door. While a preferred embodiment of the invention and a modification thereof have been disclosed herein, other variations may occur to those skilled in the art. It is contemplated that all such variations not departing from the spirit and scope of the invention hereof are to be construed in accordance with the following claims.

I claim:

1. A door lock arrangement comprising a door having a door knob assembly extending therethrough and operably associated with an adjacent door jamb, said door knob assembly having a door knob and a shank portion on one side of the door, said door lock arrangement comprising a U-shaped member positioned to partially encircle the shank portion of the door knob assembly between the door knob and the door and having the two leg portions of the U-shaped member extending in a generally horizontal direction, means associated with the door jamb for receiving the leg portions of the U-shaped member for locking the door in one position of the member, and means positioned on at least one of the leg portions for keeping the U-shaped member in said one position thereof and enabling said member to be moved to another position in an unlocked condition.

2. The door lock arrangement of claim 1 wherein the U-shaped member is a rod having a curved portion around the shank portion of the door knob assembly.

3. The door lock arrangement of claim 1 wherein the keeping means is a flexible element formed to fit over one of said leg portions and enable the U-shaped member to be moved from the shank portion of the door knob assembly.

4. The door lock arrangement of claim 1 wherein the receiving means comprise a pair of openings in the door jamb for the leg portions of the U-shaped member.

5. The door lock arrangement of claim 1 wherein the receiving means comprises a plate member secured to the door jamb and having a portion thereof extending outwardly and further having a pair of apertures in the extending portion for the leg portions of the U-shaped member.

6. The door lock arrangement of claim 5 wherein the plate member includes an aperture therein operably associated with the door knob assembly.

7. The door lock arrangement of claim 5 wherein upon opening of the door an edge portion thereof engages the leg portions of the U-shaped member to prevent further opening of the door.

8. The door lock arrangement of claim 1 wherein the keeping means comprise a pair of flexible tubular elements adjacent the shank portion of the door knob assembly and are formed to fit over the leg portions of the U-shaped member to retain the member in both the locked and the unlocked condition.

9. Door locking apparatus comprising a door having a door knob assembly for opening and closing the door and operably associated with an adjacent door jamb and including a door knob and a shank portion on one side of the door, said apparatus comprising a U-shaped member positioned around the shank portion of the door knob assembly and having the two leg portions of the U-shaped member extending generally horizontal when disposed in a locking condition and extending generally vertical when disposed in an unlocked condition, means associated with the door jamb for receiving the leg portions for locking the door in the locking condition, and means coupled to the U-shaped member and adjacent the shank portion for keeping the U-shaped member in the locking condition and enabling the member to be moved to the unlocked condition for storing thereof.

10. The apparatus of claim 9 wherein the U-shaped member is of rod construction having a curved portion around the shank portion of the door knob assembly.

11. The apparatus of claim 9 wherein the receiving means for the leg portions of the U-shaped member comprise a pair of apertures in the door jamb.

12. The apparatus of claim 9 wherein the receiving means comprises a plate member secured to a surface of the door jamb and having a portion thereof extending outwardly therefrom and further having a pair of apertures in the extending portion for receiving the leg portions.

13. The apparatus of claim 9 wherein the keeping means is a pliant tubular member formed to slip over one of the leg portions and enable the U-shaped member to be removed from the locking condition.

14. The apparatus of claim 9 wherein upon opening of the door the U-shaped member is engaged by a corner portion of the door to prevent further opening thereof.

15. The apparatus of claim 9 wherein the keeping means comprise a pair of pliant tubular elements on the leg portions of the U-shaped member adjacent the shank portion of the door knob assembly and are sized to provide frictional contact with the shank portion upon moving the member from a locked position to an unlocked position.

16. In a door lock apparatus comprising a door operably associated with a door jamb, a door knob assembly carried by the door and operable to latch and unlatch the door relative to the door jamb and having a knob portion and a shank portion, the improvement comprising a strike plate secured to the door jamb and having an extended portion defining a pair of apertures therein, a U-shaped member positioned around the shank portion and extending in a generally horizontal direction to be received in the pair of apertures in a door locking condition and to fit around the shank portion and to extend in a generally vertical direction in a door unlocking condition, and means fitting on the U-shaped member and frictionally engaging the shank portion for keeping the member in the locking condition.

17. In the lock apparatus of claim 16 wherein the U-shaped member is a rod having the two legs thereof engaged in the apertures of the strike plate and including tubular elements on the legs for retaining the member in the door locking condition.

18. In the lock apparatus of claim 17 wherein the tubular elements are pliant elements and are sized to provide frictional contact with the shank portion of the door knob assembly upon moving the member from a locked position to an unlocked position.

* * * * *